US006345608B1

(12) United States Patent
Rembold et al.

(10) Patent No.: US 6,345,608 B1
(45) Date of Patent: Feb. 12, 2002

(54) FUEL SUPPLY SYSTEM FOR AN INTERNAL COMBUSTION ENGINE

(75) Inventors: Helmut Rembold, Stuttgart; Werner-Karl Marquardt, Markgroeningen, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/509,498

(22) PCT Filed: May 4, 1999

(86) PCT No.: PCT/DE99/01329

§ 371 Date: Jun. 5, 2000

§ 102(e) Date: Jun. 5, 2000

(87) PCT Pub. No.: WO00/06895

PCT Pub. Date: Feb. 10, 2000

(30) Foreign Application Priority Data

Jul. 29, 1998 (DE) ..... 198 34 121

(51) Int. Cl.[7] ..... F02M 37/04

(52) U.S. Cl. ..... 123/506; 123/456

(58) Field of Search ..... 123/446, 506, 123/456, 457, 459, 458; 251/282, 129.02, 192.07

(56) References Cited

U.S. PATENT DOCUMENTS

| | | | | | |
|---|---|---|---|---|---|
| 4,385,614 | A | * | 5/1983 | Eheim et al. | 123/506 |
| 4,838,233 | A | * | 6/1989 | Hayashi et al. | 123/506 |
| 4,884,545 | A | * | 12/1989 | Mathis | 123/447 |
| 5,058,553 | A | * | 10/1991 | Kondo et al. | 123/456 |
| 5,957,674 | A | * | 9/1999 | Zenmei et al. | 417/505 |
| 6,045,120 | A | * | 4/2000 | Tarr et al. | 251/282 |
| 6,135,090 | A1 | * | 1/2001 | Sakasai | |

* cited by examiner

*Primary Examiner*—Carl S. Miller
(74) *Attorney, Agent, or Firm*—Ronald E. Greigg

(57) ABSTRACT

A fuel supply system with two series-connected fuel pumps including a control valve, which is relatively small, and having a very precise regulation of the quantity of fuel pumped from the first pump into a pressure line by the second fuel pump is obtained at little effort or expense. The fuel supply system is intended for an internal combustion engine of a vehicle.

27 Claims, 4 Drawing Sheets

FUEL SUPPLY SYSTEM FOR AN INTERNAL COMBUSTION ENGINE

This application is being filed simultaneously with another application by the identical inventors, further identified as R.34050, PCT/DE 99/01328, U.S. Ser. No. 09/509, 503.

PRIOR ART

The invention is based on a fuel supply system for delivering fuel for an internal combustion engine.

Until now, there have been fuel supply systems in which a first fuel pump pumps fuel out of a fuel tank to a second fuel pump via a fuel connection. The second fuel pump in turn pumps the fuel into a pressure line, to which at least one fuel valve is connected. Typically, the number of fuel valves is equal to the number of cylinders of the engine. The fuel tank can be constructed such that the fuel valve injects the fuel directly into a combustion chamber of the engine. In the operation of this fuel supply system, a high pressure in the pressure line leading to the fuel valve is necessary.

The second fuel pump is typically driven mechanically directly by the engine. The second fuel pump typically has a pump body that reciprocates in a pump chamber, and the frequency of the pump body is rigidly coupled with the engine rpm. To enable the pumping quantity of the second fuel pump to be controlled despite the rigid coupling of the pump body with the engine rpm, a control valve that controls the pumping quantity can be provided between the first fuel pump and the second fuel pump; during a compression stroke of the pump body, the control valve allows some of the fuel to flow back out of the pump chamber into the fuel connection between the first fuel pump and the second fuel pump. To prevent vapor bubbles from forming inside the spaces containing the fuel, it is important that the control valve, which monitors the connection from the first fuel pump into the pump chamber of the second fuel pump and controls the flow quantity, not throttle the inflow of fuel into the pump chamber excessively during the intake stroke of the second fuel pump. It is therefore important that the control valve have a sufficiently large flow cross section.

Because the flow cross section must be relatively large, the control valve of the prior art is relatively large overall, and to adjust the flow cross section a large, heavy electromagnet and a large, strong spring are required. Because of the requisite size of the flow cross section, it was not possible until now to construct the control valve in such a way that the control valve switches fast enough so that even at high frequency of the pump body of the second fuel pump, satisfactorily precise open- or closed-loop control, i.e., control or regulation, of the pressure in the pressure line leading to the fuel valves could be obtained.

Another disadvantage is that because of the size of the control valve required until now, a relatively long time elapses until the flow cross section of the control valve has closed completely, so that in this transition time some of the fuel flows at relatively high pressure back out of the pump chamber of the second fuel pump into the fuel connection, which means an undesired energy loss and undesired heating of the fuel.

Despite major effort and expense, it was not possible until now to regulate or control the fuel quantity pumped by the second fuel pump sufficiently precisely, including at high engine rpm, and at the same time to assure that no gas bubbles will form in the second fuel pump and that the second fuel pump will not pump any excess fuel quantity, which means an energy loss and heating of the fuel.

ADVANTAGES OF THE INVENTION

The fuel supply system according to the invention offers the advantage that the control valve can be made relatively small overall, and nevertheless, during the inflow of fuel out of the fuel connection into the pump chamber, there is relatively little flow resistance because of the relatively large flow cross section. This in turn has the advantage that upon the inflow of fuel into the pump chamber, the risk of formation of a gas bubble in the fuel is greatly reduced, despite the use of a relatively small control valve.

Because when the fuel is flowing through the opened control valve out of the pump chamber back in the direction of the fuel connection leading to the first fuel pump, the flow cross section is embodied as relatively small, the advantage is obtained that only a relatively small flow cross section has to be controlled, so that it is possible at relatively little effort or expense to embody the control valve in such a way that the flow cross section can be closed or opened very quickly.

By means of the provisions recited herein, advantageous refinements of and improvements to the fuel supply system are possible.

By the closure of the flow cross section as a function of an engine operating condition, the fuel quantity pumped by the second fuel pump can be controlled or regulated highly precisely in a very simple way and with little dissipation. The control valve embodied according to the invention can be opened and closed especially fast and with precise timing.

If the electromagnet of the adjusting drive that adjusts the valve member while the adjusting body of the adjusting drive is in its unactuated position of repose or in other words a certain time before the adjusting body is to execute its adjusting motion, is supplied variably with current adapted as a function of an engine operating condition and/or of a pressure inside the fuel supply system, in particular a head pressure engaging the valve member, and/or as a function of time, and in particular of the instantaneous position of the pump body and/or as a function of a pump rpm, then because the electromagnet builds up precisely enough force that the adjusting body remains in its position of repose, the advantage is obtained that afterward, to adjust the adjusting body out of its position of repose, only a slight change in the current has to be brought about, which can be done within an extremely short time, so that the adjusting body and thus also the valve member actuated by the adjusting body can be switched over extremely fast into the new intended position.

If the control valve is embodied such that by supplying current to the electromagnet the magnetic force generated adjusts the valve member into a closing position in which the flow cross section of the control valve is closed, then the advantage is obtained that overall current has to be supplied to the electromagnet of the control valve only relatively briefly, since the requisite period of time in which the flow cross section is to be open is usually longer than the period of time in which the flow cross section is to be closed.

If the control valve is embodied such that with waning current or if the current to the electromagnet is switched off the spring counteracting the magnetic force of the electromagnet adjusts the valve member into a closing position, in which the flow cross section is closed, then the advantage is obtained that even there is a functional failure of the electromagnet of the control valve, the second fuel pump can pump the fuel out of the fuel connection into the pressure line leading to the fuel valves.

If the control valve is embodied such that when the fuel flows out of the fuel connection into the pump chamber the valve member can lift away from the adjusting body of the adjusting drive, then the advantage is obtained that only the valve member, which has only relatively little mass, has to be moved, which is advantageously expressed in a rapid response of the valve member to pressure changes. A further advantage is that the adjusting body overall has to cover only a little distance, and nevertheless it is possible for the valve member to cover an overall longer adjustment path.

If the control valve is embodied as a so-called seat valve, then with a relatively short adjustment path of the valve member, a relatively large flow cross section can advantageously be controlled or opened and closed.

BRIEF DESCRIPTION OF THE DRAWINGS

Selected, especially advantageous exemplary embodiments of the invention are shown in simplified form in the drawings and described in further detail below.

DESCRIPTION OF THE EXEMPLARY EMBODIMENTS

The fuel supply system according to the invention for metering fuel for an internal combustion engine can be used by various kinds of internal combustion engine. An Otto fuel, in particular gasoline, is preferably used as the fuel. By way of example, the engine is an Otto engine with external or internal mixture formation and externally supplied ignition; the engine can be supplied with a reciprocating piston (reciprocating piston engine) or a rotatably supported piston (Wankel or rotary engine). The ignition of the fuel-air mixture is done in the usual way with a spark plug. The internal combustion engine is a hybrid engine, by way of example. In such an engine with a stratified charge, the fuel-air mixture in the combustion chamber is enriched in the region of the spark plug enough to guarantee reliable ignition, but on average the combustion takes place with a lean-to-down mixture.

The gas exchange in the combustion chamber of the engine can be done for instance by the four-stroke or the two-stroke process. For controlling the gas exchange in the engine combustion chamber, gas exchange valves (inlet valves and outlet valves) can be provided in a known manner. The engine can be embodied in such a way that at least one fuel valve injects the fuel directly into the combustion chamber of the engine. Controlling the power of the engine is done, depending on the mode of operation, by controlling the quantity of fuel delivered to the combustion chamber. However, an operating mode also exists in which the air supplied to the combustion chamber for combustion of the fuel is controlled with a throttle valve. The power output by the engine can also be controlled by the position of the throttle valve.

The engine by way of example has one cylinder with a piston, or it can be provided with a plurality of cylinders and a corresponding number of pistons. Preferably, one fuel valve is provided per cylinder.

In order not to make the description excessively long, the ensuing description of the exemplary embodiments is limited to a reciprocating piston engine with four cylinders as the internal combustion engine; the four fuel valves inject the fuel, typically gasoline, directly into the combustion chamber of the engine. The ignition of the fuel in the combustion chamber is effected via a spark plug. Depending on the mode of operation, the power of the engine can be controlled by way of controlling the injected fuel quantity or by way of throttling the inflowing air. At idle and at lower partial load, charge stratification is effected, with fuel enrichment in the region of the spark plug. Outside this region around the spark plug, the mixture is very lean. At full load or upper partial load, a homogeneous distribution between fuel and air is the goal throughout the entire combustion chamber.

Figure 1:
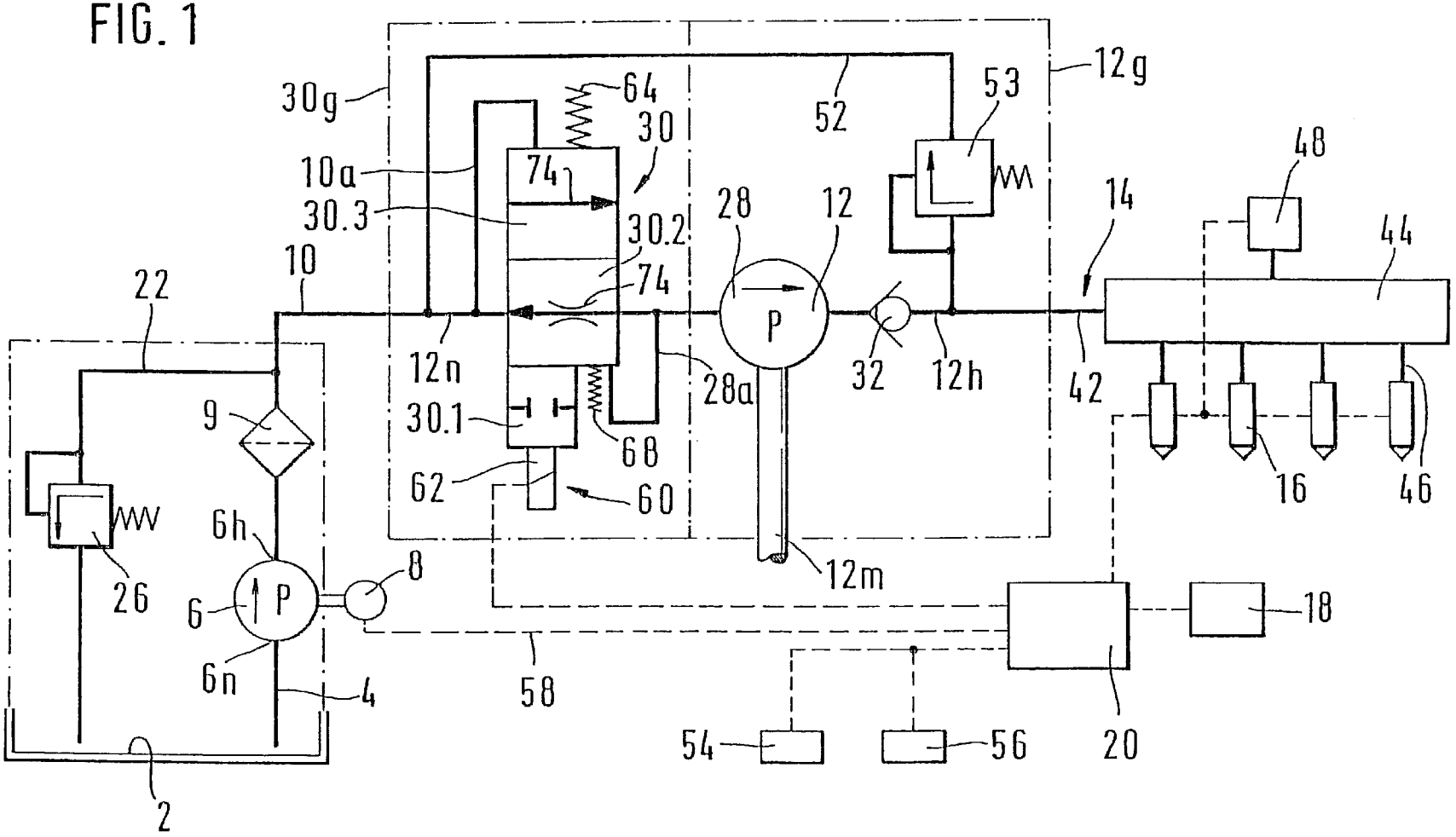
FIG. 1 in symbolic form shows a preferred selected advantageous exemplary embodiment.

FIG. 1 shows a fuel tank 2, an intake line 4, a first fuel pump 6, an electric motor 8, a filter 9, a fuel connection 10, a second fuel pump 12, a pressure line 14, four fuel valves 16, an electrical energy supply unit 18, and an electric or electronic control unit 20. In professional circles, the fuel valves 16 are often referred to as injection valves or injectors.

The first fuel pump 6 has a compression side **6*h* and an intake side 6*n*. The second fuel pump 12 has a high-pressure side 12*h* and a low-pressure side 12*n*. The fuel connection 10 leads from the compression side 6*h* of the first fuel pump 6 to the low-pressure side 12*n* of the second fuel pump 12. A fuel line 22 branches off from the fuel connection 10. By way of the fuel line 22, fuel can be fed out of the fuel connection 10 directly back into the fuel tank 2. A pressure regulating valve or pressure control valve 26 is provided in the fuel line 22. The pressure control valve 26 functions like a pressure limiting valve or a differential pressure valve; it assures that a substantially constant feed pressure will prevail in the fuel connection 10, regardless of how much fuel is drawn out of the fuel connection 10 by the second fuel pump 12. The pressure control valve 26** regulates the pressure to 3 bar, for instance, which is equivalent to 300 kPa.

The first fuel pump 6 is driven by the electric motor 8. The first fuel pump 6, the electric motor 8, and the pressure control valve 26 are located in the region of the fuel tank 2. These elements are preferably disposed on the outside of the fuel tank 2, or are located inside the fuel tank 2, as symbolically represented by a dot-dash line.

Via a mechanical transmission means **12*m*, the second fuel pump 12 is mechanically coupled to a power takeoff shaft, not shown, of the engine. Since the second fuel pump 12 is mechanically rigidly coupled to the power takeoff shaft of the engine, the second fuel pump 12** functions purely in proportion with the rpm of the power takeoff shaft of the engine. Depending on the instantaneous operating condition of the engine, the rpm of the power takeoff shaft is quite variable. The power takeoff shaft is for example a camshaft of the engine.

The second fuel pump 12 has a pump chamber 28. There is a control valve 30 on the inlet side upstream of the pump chamber 28, on the low-pressure side 12n of the second fuel pump 12. The control valve 30 serves substantially to control the quantity of fuel to be pumped by the second fuel pump 12, which is why the control valve 30 can also be called a quantity control valve. This will be explained in further detail hereinafter. A check valve 32 is provided on the outlet side in the pressure line 14, on the high-pressure side **12*h* of the second fuel pump 12**.

The second fuel pump 12 is located inside a housing **12*g* symbolically represented by dot-dash lines. The check valve 32 can also be located inside the housing 12*g*. The control valve 30 has a valve housing 30***g*. The valve housing 30*g* is flanged to the housing 12*g* or integrated with the housing 12*g*. The control valve 30 can also be built directly into the housing 12*g*.

The pressure line 14, leading from the second fuel pump 12 to the fuel valves 16, can be subdivided for simplicity into a line portion 42, a storage chamber 44, and distributor lines 46. The fuel valves 16 are each connected to the storage chamber 44 via a respective distributor line 46. A pressure sensor 48 is connected to the storage chamber 44 and senses the pressure at the time of the fuel in the pressure line 14. As a function of this pressure, the pressure sensor 48 emits an electrical signal to the control unit 20.

If the pressure of the fuel in the pressure line 14 is too high, then fuel is carried out of the pressure line 14 into the fuel connection 10 via a return line 52. There is an overpressure valve 53 in the return line 52. The overpressure valve 53 assures that the pressure of the fuel in the pressure line 14 cannot exceed a certain maximum pressure, even if because of some kind of defect the second fuel pump 12 pumps more fuel into the pressure line 14 than is desired.

The fuel supply system also includes one sensor 54 or a plurality of sensors 54 and an accelerator pedal sensor 56. The sensors 54, 56 sense the operating condition under which the engine is operating. The engine operating condition can be a composite of a plurality of individual operating conditions. Examples of these individual operating conditions are the temperature and/or pressure of the fuel in the fuel connection 10, the temperature and/or pressure of the fuel in the pressure line 14, the air temperature, coolant temperature, or oil temperature, the rpm of the engine or the rpm of the power takeoff shaft of the engine, the composition of the engine exhaust gas, the injection time of the fuel valves 16, and so forth. The accelerator pedal sensor 56 is located in the region of the accelerator pedal and as a further individual operating condition detects the position of the accelerator pedal and thus the speed desired by the driver.

The electric motor 8, the fuel valves 16, the pressure sensor 48 and the sensors 54, 56 are connected to the control unit 20 via electrical lines 58. The electrical line 58 between the fuel valves 16 and the control unit 20 is embodied such that the control unit 20 can trigger each of the fuel valves 16 separately. For the sake of better distinguishing them from the other, nonelectrical lines, the electrical lines 58 are shown in dashed lines in the drawing.

The first fuel pump 6 is by way of example a robust positive displacement pump, which is easy to manufacture and substantially pumps a certain, constant quantity of fuel.

The pressure of the fuel in the fuel connection 10 on the compression side 6*h* of the first fuel pump 6 will hereinafter be called the feed pressure. In the proposed fuel supply system, the pressure control valve 26 determines the feed pressure in the fuel connection 10.

The second fuel pump 12 pumps the fuel out of the fuel connection 10, through the control valve 30, into the pump chamber 28 and out of the pump chamber 28 into the pressure line 14 through the check valve 32 on the outlet side. During normal operation, the pressure in the pressure line 14 can be about 100 bar, for instance, which is the equivalent of 10 MPa. It is therefore important to assure that the second fuel pump 12 will pump precisely the quantity of fuel instantaneously required into the pressure line 14, so that as much as possible no fuel has to be returned from the pressure line 14 to the low-pressure region of the fuel supply system, which would involve highly undesirable and unnecessary dissipation.

The control valve 30 shown symbolically in FIG. 1 can be switched into a valve position 30.1, a second valve position 30.2, and a third valve position 30.3. The symbolically represented valve positions 30.1, 30.2, 30.3 are shown in different sizes solely for the sake of greater clarity.

Figure 2:
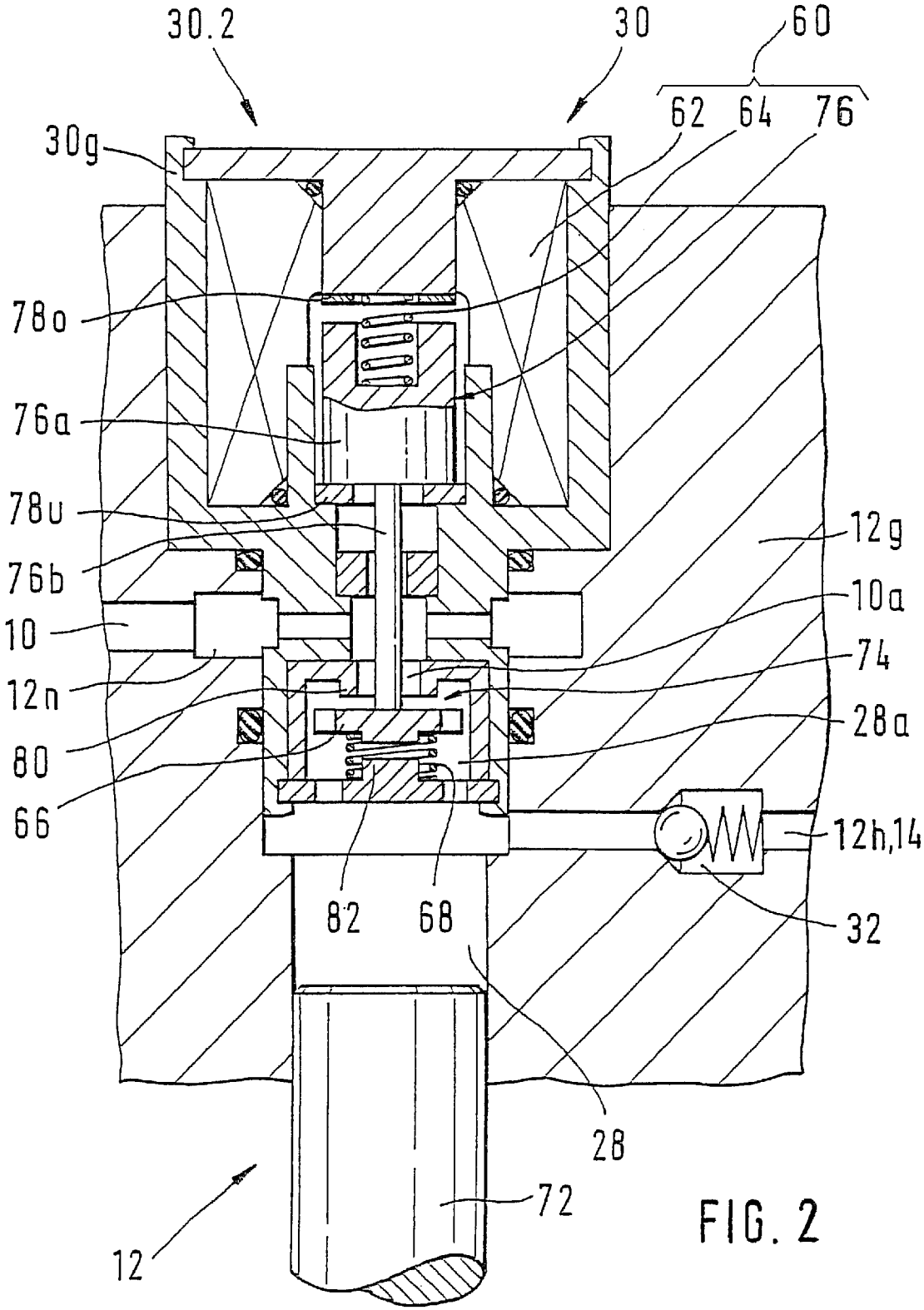
FIG. 2 shows a cross sectional detail of the exemplary embodiment of a fuel system.

The control valve 30 has an adjusting drive 60. The adjusting drive 60 includes substantially an electromagnet 62 and a spring 64 that counteracts the magnetic force of the electromagnet 62. By supplying the electromagnet 62 with current or not supplying it with current, the control valve 30 is switched into the first valve position 30.1 or the second valve position 30.2, respectively. The control valve 30 has a valve member 66 (FIG. 2). The valve member 66 can be actuated by the flow of fuel flowing through the control valve 30, counter to the force of a contact spring 68. When there is a flow of fuel out of the fuel connection 10 into the pump chamber 28 of the second fuel pump 12, or in other words when the pressure in the fuel connection 10 is greater than the pressure in the pump chamber 28, the valve member 66 (FIG. 2) is adjusted by the flow of fuel counter to the force of the contact spring 68 in such a way that the control valve 30 is in the third valve position 30.3 shown symbolically in FIG. 1. If the pressure in the pump chamber 28 is greater than in the fuel connection 10, then the fuel flows from the pump chamber 28 back into the fuel connection 10, and the valve member 66 is adjusted such that the control valve 30 is in the second valve position 30.2 shown symbolically in FIG. 1. The contact spring 68 also assures that the valve member 66 (FIG. 2) can follow the adjusting motion executed by the adjusting drives 60, and the control valve 30 can reach the first valve position 30.1. In order to show in the drawing that the control valve 30 can be switched between the two valve positions 30.2 and 30.3 as a function of pressure, two control lines or control chambers 10*a* and 28*a* are shown symbolically in FIG. 1.

In the first valve position 30.1, the communication, or a flow cross section 74, between the fuel connection 10 and the pump chamber 28 is blocked. In the second valve position 30.2, the control valve 30 has opened the flow cross section 74 only somewhat, and the fuel can flow with a certain throttling out of the pump chamber 28 back into the fuel connection 10. In the third valve position 30.3, the control valve 30 has opened the flow cross section 74 widely, and the fuel can flow, largely unthrottled, out of the fuel connection 10 into the pump chamber 28.

The second fuel pump 12 is constructed such that the pump chamber 28 increases and decreases in size in alternation, while the engine drives the second fuel pump 12 via the transmission means 12*m*. For instance, if a pump body 72 (FIG. 2) supported in the housing 12*g* is driven to execute an axially reciprocating motion by the engine via the mechanical transmission means 12*m*, the pump chamber 28 increases or decreases in size. During an intake stroke of the second fuel pump 12, or in other words when the pump body 72 is moving downward (in terms of FIG. 2), the pump chamber 28 increases in size. During a compression stroke, that is, when the pump body 72 is pressed upward (in terms of FIG. 2), the pump chamber 28 decreases in size.

During an intake stroke, during which the pump chamber 28 increases in size, the electromagnet 62 does not receive current, and the fuel flowing out of the fuel connection 10 into the pump chamber 28 adjusts the valve member 66 (FIG. 2), so that the control valve 30 is in the third valve position 30.3, and as a result the flow cross section 74 of the control valve 30 is widely opened, and the fuel can flow largely unthrottled out of the fuel connection 10 into the pump chamber 28. In an average engine operating condition, in the ensuing compression stroke, during which the pump chamber 28 shrinks, the electromagnet 62 initially receives no current, and the control valve 30 is in its second valve position 30.2. As long as the control valve 30 is in the valve position 30.2, the second fuel pump 12 forces the fuel back out of the pump chamber 28 into the fuel connection 10, through the control valve 30. As a function of the instantaneous engine operating condition, and especially depending on which pressure the pressure sensor 48 in the pressure line 14 senses, and depending on how much fuel the fuel valves 16 are intended to inject into the engine combustion chambers at the moment, the control unit 20 calculates the instant at which the flow cross section 74 of the control valve 30 should be closed. For closing the flow cross section 74, current is supplied to the electromagnet 62, and the control valve 30 is switched into its first valve position 30.1. Since before that the control valve 30 was in its second valve position 30.2, in which the flow cross section 74 is not maximally opened, the distance the valve member 66 (FIG. 2) has to cover to close the flow cross section 74 is relatively short, so that the closure of the flow cross section 74 can take place very fast. This is necessary to enable achieving a very precise regulation of the pressure of the fuel in the pressure line 14. Because the flow cross section 74 can be closed very fast and then opened again very fast, it is possible even to use a very high-speed second fuel pump 12, in which the pump body 72 is moved very rapidly back and forth, so that the pump chamber 28 enlarges or shrinks very quickly. Since with a high-speed pump body 72 (FIG. 2) the times for the intake stroke and the compression stroke are very short, it is important that the control valve 30 open and close the flow cross section 74 quickly and precisely. By the choice of the instant at which, during a compression stroke, the control valve 30 is switched over from the second valve position 30.2 to the first valve position 30.1, the quantity of fuel that the second fuel pump pumps out of the fuel connection 10 into the pressure line 14 per compression stroke can be determined.

FIG. 2 shows as an example a detail of the first exemplary embodiment. Those elements not shown in FIG. 2 correspond to what is shown in the other drawings. FIG. 2 substantially shows a longitudinal section through the control valve 30, which is in its unactuated switching position 30.2.

In all the drawing figures, identical or identically functioning elements are provided with the reference numerals. Unless otherwise noted or shown in the drawing, what is said and shown in conjunction with one of the drawing figures applies to the other exemplary embodiments as well. Unless otherwise stated in the description, the details of the various exemplary embodiments can be combined with one another.

The adjusting drive 60 includes, along with the electromagnet 62 and the spring 64, an adjusting body 76. The adjusting body 76 is composed of an armature 76*a* and a tappet 76*b* solidly connected to the armature 76*a*. When the electromagnet 62 is not receiving current, the spring 64 presses the adjusting body 76 downward (in terms of FIG. 2), until the armature 76*a* comes to rest on a lower stop disk 78*u* provided on the valve housing 30*g*. If the electromagnet 62 is supplied with sufficiently high current, the adjusting body 76 is actuated upward (in terms of FIG. 2) counter to the force of the spring 64, until the armature 76*a* rests on an upper stop disk 780 provided on the valve housing 30*g*.

A valve seat 80 is provided on the valve housing 30*g*. If there is no current to the electromagnet 62, then the flow cross section 74 extending between the valve seat 80 and the valve member 66 is opened as widely as shown in FIG. 2. FIG. 2 shows the control valve 30 in the second valve position 30.2. In the second valve position 30.2, the spacing between the valve seat 80 and the valve member 66 is relatively slight, so that for the switchover to the first valve position 30.1 (FIG. 1), the adjusting body 76 needs to be moved upward (in terms of FIG. 2) only very slightly until the valve member 66 comes to rest on the valve seat 80 for closure of the flow cross section 74. As a result, the flow cross section 74 can be closed very fast. The closure of the flow cross section 74 is reinforced by the pressure, which increases in the pump chamber 28 during the compression stroke. As FIG. 2 shows, the pressure in the control chamber 10*a*, in which substantially the same feed pressure prevails as in the fuel connection 10, acts upon the valve member 66 downward in the opening direction, and the pressure in the control chamber 28*a*, in which substantially the same pressure as in the pump chamber 28 prevails, urges the valve member 66 upward in the closing direction.

During an intake stroke, the pump body 72 moves downward (in terms of FIG. 2). As a result, the pressure of the fuel in the pump chamber 28 drops below the feed pressure of the fuel in the fuel connection 10. This pressure difference urges the valve member 66 downward (in terms of FIG. 2), counter to the force of the contact spring 68. The force of the contact spring 68 is rather slight, so that even a small pressure difference between the fuel connection 10 and the pump chamber 28 presses the valve member 66 hydraulically downward (in terms of FIG. 2). This assures that the pressure in the pump chamber 28 will not drop too far, and thus that no undesired gas bubbles can form in the pump chamber 28. If the valve member 66 is moved hydraulically downward (in terms of FIG. 2), then the valve member 66 lifts up from the adjusting body 76 of the adjusting drive 60. This lifting away means that the valve member 66 hydraulically acted upon by the pressure difference between the pump chamber 28 and the fuel connection 10 overall has only a small mass to be moved, which has the advantage that even a small pressure difference very quickly adjusts the valve member 66 dynamically in the particular direction desired. In other words, even a small pressure difference adjusts the valve member 66 downward (in terms of FIG. 2) or upward (in terms of FIG. 2), counter to the force of the contact spring 68, until the valve member 66 comes to rest either on the tappet 76*b* of the adjusting body 76 or on the valve seat 80. The valve member 66 can lift away from the valve seat 80 or the adjusting body 76 far enough that the valve member 66 comes to contact a valve member stop 82 provided on the valve housing 30*g*.

In the exemplary embodiment shown in FIGS. 1 and 2, the control valve 30, as a result of a supply of current to the electromagnet 62, is adjusted into the first valve position 30.1 (FIG. 1), in which the flow cross section 74 is closed. In contrast to that, in the exemplary embodiment described below in conjunction with FIGS. 3 and 4, the flow cross section 74 is opened when current is supplied to the electromagnet 62. In comparison to the exemplary embodiment shown in FIGS. 1 and 2, the directions of the magnetic force of the electromagnet 62 and the spring force of the spring 64 of the adjusting drive 60 are transposed in the exemplary embodiment shown in FIGS. 3 and 4.

Figure 3:
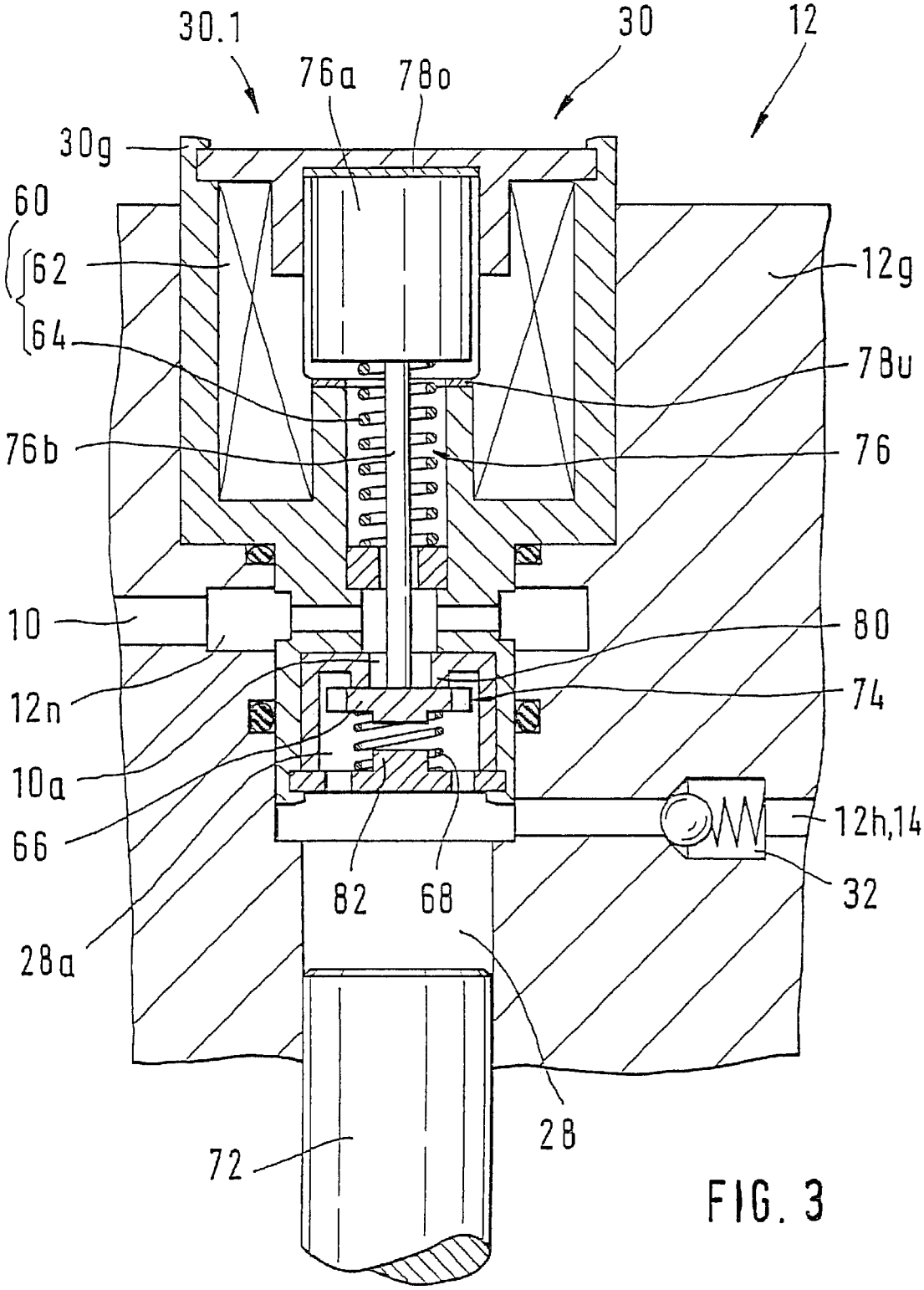
FIGS. 3 and 4 show a detail of further, especially advantageously embodied exemplary embodiment of a control valve of the fuel supply system.
Figure 4:
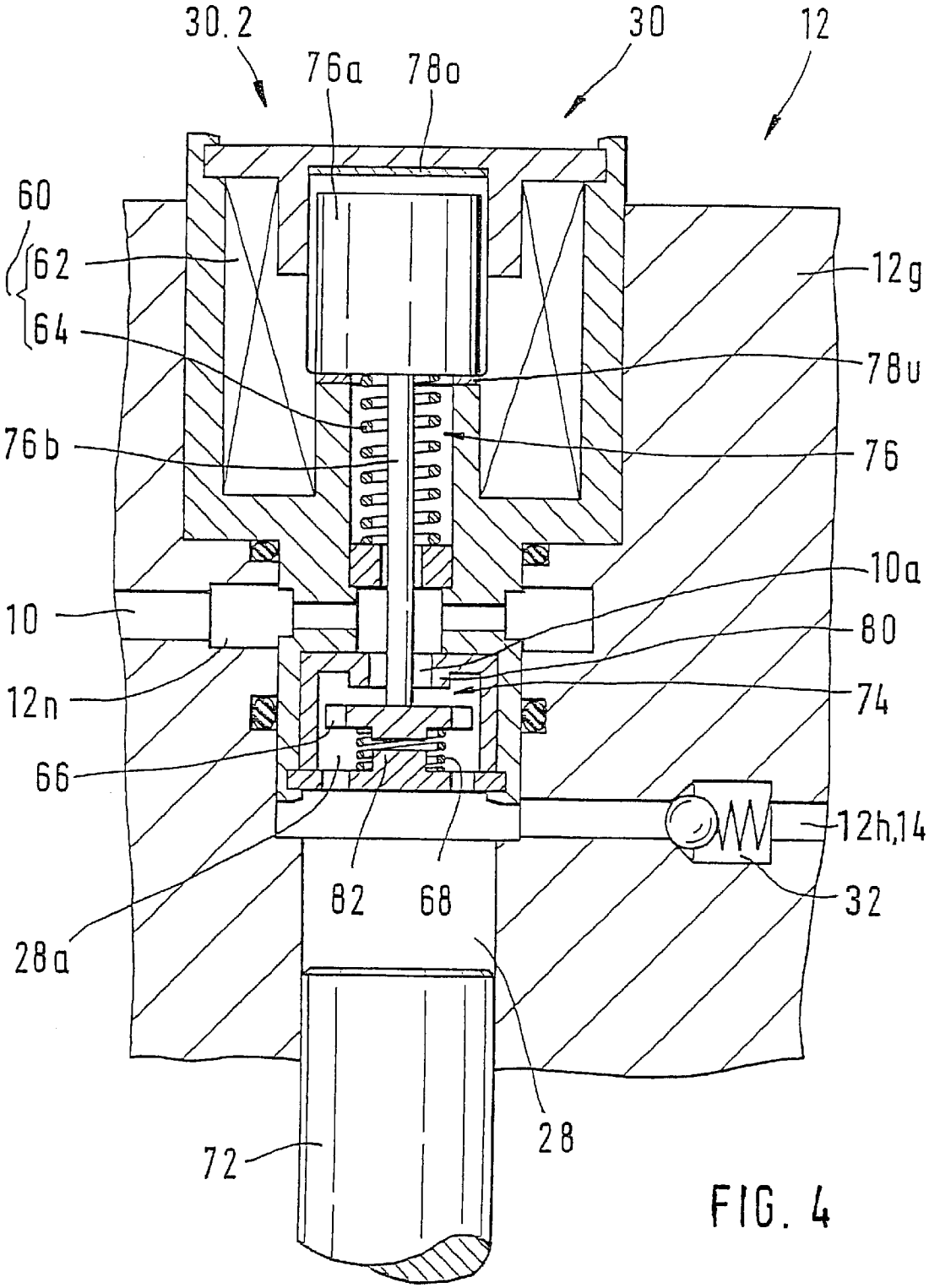

FIGS. 3 and 4 show a further preferred, selected and especially advantageous exemplary embodiment. FIG. 3 shows the exemplary embodiment when the electromagnet 62 is not receiving current, so that the control valve 30 is in the first valve position 30.1, in which the flow cross section 74 is closed. FIG. 4 shows the second exemplary embodiment with the electromagnet 62 receiving full current, and as a result the control valve 30 in the second valve position 30.2 is full open.

When the pump chamber 28, in the exemplary embodiment shown in FIGS. 3 and 4, enlarges during an intake stroke, the pressure in the pump chamber 28 then drops, and the fuel flows out of the fuel connection 10 through flow cross section 74 into the pump chamber 28; the fuel flowing through lifts the valve member 66 away from the valve seat 80. In the process, the flow cross section 74 can open fully, so that the fuel can flow into the pump chamber 28 with only a very slight pressure loss.

During the intake stroke, it is not absolutely necessary for the electromagnet 62 to receive current. However, it is proposed that at least toward the end of the intake stroke, and no later than just before the onset of the pressure stroke, current be supplied to the electromagnet 62 so that the adjusting body 76 is adjusted downward into the valve position 30.2 shown in FIG. 4. This assures that at the onset of the compression stroke, the flow cross section 74 is open, so that the fuel not needed in the pressure line 14 can flow back into the fuel connection 10. Since at the onset of the compression stroke the valve member 66 is contacting the adjusting body 76, and only a slight spacing exists between the valve seat 80 and the valve member 66, the valve member 66 has to traverse only a short distance in order to close the flow cross section 74, and thus the closure of the flow cross section 74 can happen very fast. During the compression stroke, the flow cross section 74 can be substantially smaller than during the intake stroke.

On the basis of calculations, the control unit 20 determines the instant at which, during the compression stroke, the supply of current to the electromagnet 62 is switched off, as a result of which the adjusting body 76 is moved upward (in terms of FIGS. 3 and 4), and the valve member 66, by contacting the valve seat 80, closes the flow cross section 74. By switching off the current supply to the electromagnet 62 of the adjusting drive 60, the control valve 30 can be switched very fast, during a compression stroke, from the second valve position 30.2 shown in FIG. 4 to the first valve position 30.1 shown in FIG. 3. After the switchover to the first valve position 30.1, the pump body 72 forces the fuel out of the pump chamber 28 through the check valve 32 on the outlet side and into the pressure line 14. By varying the instant of the switchover of the control valve 30, whatever quantity of fuel is required at the time can be pumped into the pressure line 14 with high metering accuracy.

The fuel supply system has an emergency function to be described below: If in the exemplary embodiment shown in FIGS. 3 and 4 the electromagnet 62 should fail because of a defect, or if its current supply is interrupted, then during the entire compression stroke the valve member 66 is in position shown in FIG. 3, in which the flow cross section 74 is closed, so that the entire quantity of fuel positively displaced out of the pump chamber 28 during the compression stroke is pumped through the check valve 32 on the outlet side into the pressure line 14. During the intake stroke, the valve member 66 can lift away from the valve seat 80 even if the electromagnet 62 should fail, as described above. If the electromagnet 62 of the adjusting drive 60 fails, the second fuel pump 12 can still pump, although without the option of precise metering of the fuel quantity pumped into the pressure line 14. The excess portion of fuel not needed by the fuel valves 16 and therefore not drawn leads to a pressure increase in the pressure line 14, until the overpressure valve 53 (FIG. 1) responds and the unneeded fuel is carried out of the pressure line 14 through the return line 52 back into the fuel connection 10, or in a modified version back into the fuel tank 2. If the electromagnet 62 fails, the engine can continue operation with an emergency function. As soon as the control unit 20 finds that the pressure sensor 48 is sensing a pressure that is higher than the pressure that would result from triggering of the control valve 30, the control unit 20 detects the fact that the emergency function has occurred. Since during the emergency function precise metering of the fuel quantity pumped into the pressure line 14 is not possible, it is proposed that the control unit 20 be embodied such that an appropriate error report is displayed.

Below is also an indication of how the length of time needed for the switchover of the control valve 30 can be substantially shortened still further: To enable the spring 64 to actuate the valve member 66 into the second valve position 30.2 shown in FIG. 2 and keep it there in all the incident operating conditions in the exemplary embodiment shown in FIGS. 1 and 2, that is, at all the incident pressures in the fuel connection 10 and in the pump chamber 28 and in all flow velocities of the fuel through the flow cross section 74, the spring 64 must be designed to be sufficiently strong. However, operating conditions also exist in which the full force of the spring 64 is not needed to hold the valve member 66 in the second valve position 30.2. To allow the switchover to proceed even faster afterward, when the valve member 66 is supposed to close the flow cross section 74, it is proposed that as long as the valve member 66 is still intended to remain in the second valve position 30.2, the electromagnet 62 be supplied with current long enough that the force of the spring 64, minus the magnetic force of the electromagnet 62, is precisely sufficient to keep the valve member 66 reliably in the second valve position 30.2. If the instant at which the flow cross section 74 is supposed to be closed then arrives, a relatively slight additional supply of current to the electromagnet 62 suffices. This slight additional supply of current to the electromagnet 62 can be accomplished in a substantially shorter time than if the electromagnet 62 had to be supplied with current beginning at a completely currentless state.

One substantial influence on the requisite force for keeping the valve member 66 in the second valve position 30.2 is the pressure of the fuel in the pump chamber 28 upon the expulsion of the fuel back out of the pump chamber 28 into the fuel connection 10. In the pump chamber 28, this substantially involves a head pressure. The head pressure is determined primarily by the flow velocity at which the fuel is positively displaced out of the pump chamber 28. The flow velocity depends on the speed of the pump body 72 as it moves upward. The speed of the pump body 72 is determined by the pump rpm at which the fuel pump 12 is driven by the camshaft. It is therefore proposed that the electromagnet 62 be supplied with current preferably as a function of the head pressure engaging the valve member 66, so that only a slight additional supply of current then needs to be expended for the switchover. Since the head pressure depends on the speed of the upward-moving pump body 72, which in turn corresponds to the pump rpm, it is proposed that the electromagnet 62 be supplied with current as a function of the pump rpm.

If at the onset of the compression stroke the control valve 30 is in the second valve position 30.2 and the flow cross section 74 is open, then the head pressure acting in the closing direction and engaging the valve member 66 at a low pump rpm is less than at a high rpm. For holding the valve member 66 in the second valve position 30.2, the force of the adjusting drive 60 in the opening direction must accordingly be substantially greater at a high pump rpm than at a low pump rpm. To achieve the shortest possible closing time at all pump speeds, it is proposed that sometime before the intended switchover from the second valve position 30.2 (FIG. 2) to the first valve position 30.1, the electromagnet 62 already be supplied with some current beforehand, specifically a higher current the lower the pump rpm.

In the exemplary embodiment shown in FIGS. 3 and 4 as well, the length of time needed for the switchover of the control valve 30 can additionally be shortened substantially. The electromagnet 62 of the adjusting drive 60 must be designed as sufficiently strong so that if needed under all operating conditions the electromagnet 62 is capable of holding the valve member 66 in the second valve position 30.2, shown in FIG. 4, in which the flow cross section 74 is open. However, under the predominant percentage of operating conditions, the requisite magnetic force of the electromagnet 62 for holding the valve member 66 is less. It is proposed that at those operating conditions at which a lesser magnetic force of the electromagnet 62 suffices to keep the valve member 66 in the second valve position 30.2, the supply of current to the electromagnet 62 be correspondingly less. If the flow cross section 74 is next supposed to be completely closed, then the magnetic force of the electromagnet 62 drops to zero substantially faster, and the spring 64 can actuate the adjusting body 76 upward (in terms of FIG. 4) substantially faster than if the electromagnet 62 were receiving maximum current in the second valve position 30.2.

To obtain the shortest possible closing time at all pump speeds, it is proposed that sometime before the intended switchover from the second valve position 30.2 (FIG. 4) to the first valve position 30.1 (FIG. 3), the electromagnet 62 already be supplied beforehand with somewhat less current, specifically less current the lower the pump rpm.

Since the voltage of the electrical energy supply unit 14 (FIG. 1) is typically limited, it takes a certain time from the onset of turn-on of the electromagnet 62 for the electromagnet 62 to act with its full, maximum magnetic force on the adjusting body 76. In the exemplary embodiment shown in FIGS. 3 and 4, upon switchover of the magnetic force of the electromagnet 62, the flow cross section 74 is closed; especially the closure of the flow cross section 74 is supposed to happen especially quickly, within the shortest possible time. Since it is possible to embody the control unit 20 such that the turn-off of the magnetic force occurs faster than the turn-on of magnetic force, the result in the exemplary embodiment shown in FIGS. 3 and 4 is advantageously and especially short closing time in the closure of the flow cross section 74, since here for the closure of the flow cross section 74 the magnetic force of the electromagnet 62 has to be switched off. In the second exemplary embodiment, the quantity of fuel pumped by the second fuel pump 12 can therefore be controlled especially precisely.

The foregoing relates to a preferred exemplary embodiments of the invention, it being understood that other variants and embodiments thereof are possible within the spirit and scope of the invention, the latter being defined by the appended claims.

We claim:

1. A fuel supply system for delivering fuel for an internal combustion engine, comprising a fuel tank (2), a first fuel pump (6), a second fuel pump (12), a pressure line (14) connected to a high pressure side of the second pump (12) to which at least one fuel valve (16) is connected, by way of said fuel valve the fuel can at least indirectly reach a combustion chamber of the engine, the first fuel pump (6) pumps the fuel out of the fuel tank (2) into a fuel connection (10), and the second fuel pump (12) has a pump chamber (28) and substantially pumps the fuel out of the fuel connection (10) through a control valve (30) with a variable flow cross section (74) into the pump chamber (28) and out of the pump chamber (28) into the pressure line (14), the control valve (30) includes a valve member (66) which varies a flow cross section (74), and the valve member (66) varies the flow cross section (74) in such a way that upon a flow of fuel out of the fuel connection (10) into the pump chamber (28), the flow cross section (74) is greater than upon a flow of fuel out of the pump chamber (28) into the fuel connection (10).

2. The fuel supply system according to claim 1, in which the valve member (66) can close the flow cross section (74) as a function of an engine operating condition.

3. The fuel supply system according to claim 1, in which the valve member (66) is adjustable by a drivable adjusting body (76) of an adjusting drive (60), and for adjusting the adjusting body (66) the adjusting drive (60) includes an electromagnet (62) and a spring (64) that acts counter to a magnetic force of the electromagnet (62).

4. The fuel supply system according to claim 2, in which the valve member (66) is adjustable by a drivable adjusting body (76) of an adjusting drive (60), and for adjusting the adjusting body (66) the adjusting drive (60) includes an electromagnet (62) and a spring (64) that acts counter to a magnetic force of the electromagnet (62).

5. The fuel supply system according to claim 3, in which the adjusting body (76) has an unactuated position of repose, and while the adjusting body (76) remains in the unactuated position of repose, the electromagnet (62) is supplied with current as a function of an engine operating condition.

6. The fuel supply system according to claim 4, in which the adjusting body (76) has an unactuated position of repose, and while the adjusting body (76) remains in the unactuated position of repose, the electromagnet (62) is supplied with current as a function of an engine operating condition.

7. The fuel supply system according to claim 3, in which the adjusting body (76) has an unactuated position of repose, and while the adjusting body (76) remains in the unactuated position of repose, the electromagnet (62) is supplied with current as a function of a head pressure engaging the valve member (66).

8. The fuel supply system according to claim 4, in which the adjusting body (76) has an unactuated position of repose, and while the adjusting body (76) remains in the unactuated position of repose, the electromagnet (62) is supplied with current as a function of a head pressure engaging the valve member (66).

9. The fuel supply system according to claim 3, in which the adjusting body (76) has an actuated position, and while the adjusting body (76) remains in the actuated position, the electromagnet (62) is supplied with current as a function of a head pressure engaging the valve member.

10. The fuel supply system according to claim 4, in which the adjusting body (76) has an actuated position, and while the adjusting body (76) remains in the actuated position, the electromagnet (62) is supplied with current as a function of a head pressure engaging the valve member.

11. The fuel supply system according to claim 3, in which the adjusting body (76) has an unactuated position of repose, and while the adjusting body (76) remains in the unactuated position of repose, the electromagnet (62) is supplied variously with current as a function of time.

12. The fuel supply system according to claim 4, in which the adjusting body (76) has an unactuated position of repose, and while the adjusting body (76) remains in the unactuated position of repose, the electromagnet (62) is supplied variously with current as a function of time.

13. The fuel supply system according to claim 3, in which the magnetic force generated by supplying current to the electromagnet (62) assures a closing position of the valve member (66) that closes the flow cross section (74).

14. The fuel supply system according to claim 4, in which the magnetic force generated by supplying current to the electromagnet (62) assures a closing position of the valve member (66) that closes the flow cross section (74).

15. The fuel supply system according to claim 3, in which a closing force of the counteracting spring (64) that becomes operative as the current supply to the electromagnet (62) wanes assures a closing position of the valve member (66) that closes the flow cross section.

16. The fuel supply system according to claim 4, in which a closing force of the counteracting spring (64) that becomes operative as the current supply to the electromagnet (62) wanes assures a closing position of the valve member (66) that closes the flow cross section.

17. The fuel supply system according to claim 3, in which the valve member (66), when the fuel is flowing out of the fuel connection (10) into the pump chamber (28), lifts away from the adjusting body (76).

18. The fuel supply system according to claim 4, in which the valve member (66), when the fuel is flowing out of the fuel connection (10) into the pump chamber (28), lifts away from the adjusting body (76).

19. The fuel supply system according to claim 3, in which a contact spring (68) is provided that presses the valve member (66) against the drivable adjusting body (76) of the adjusting drive (60).

20. The fuel supply system according to claim 4, in which a contact spring (68) is provided that presses the valve member (66) against the drivable adjusting body (76) of the adjusting drive (60).

21. The fuel supply system according to claim 17, in which the valve member (66) lifts away from the adjusting body (76) counter to a force of the contact spring (68).

22. The fuel supply system according to claim 19, in which the valve member (66) lifts away from the adjusting body (76) counter to a force of the contact spring (68).

23. The fuel supply system according to claim 17, in which when the valve member (66) lifts away from the adjusting body (76), a spacing between a valve seat (80) of the control valve (30) and the valve member (66) is increased.

24. The fuel supply system according to claim 19, in which when the valve member (66) lifts away from the adjusting body (76), a spacing between a valve seat (80) of the control valve (30) and the valve member (66) is increased.

25. The fuel supply system according to claim 1, in which the second fuel pump has a drivable pump body (72), and by means of the driving of the pump body (72), the pump body (72) alternatingly increases and decreases the size of the pump chamber (28).

26. The fuel supply system according to claim 2, in which the second fuel pump has a drivable pump body (72), and by means of the driving of the pump body (72), the pump body (72) alternatingly increases and decreases the size of the pump chamber (28).

27. The fuel supply system according to claim 1, in which the control valve (30) is a seat valve.

* * * * *